United States Patent [19]

Bush

[11] Patent Number: 5,056,711

[45] Date of Patent: Oct. 15, 1991

[54] SAFE T BOX

[76] Inventor: Dan R. Bush, 230 Fort Boreman Ave., Parkersburg, W. Va. 26101

[21] Appl. No.: 430,165

[22] Filed: Nov. 1, 1989

[51] Int. Cl.[5] ..... B65D 9/00

[52] U.S. Cl. ..... 232/17; 232/45

[58] Field of Search ..... 232/43.1, 17, 45

[56] References Cited

U.S. PATENT DOCUMENTS

| | | | |
|---|---|---|---|
| 2,552,628 | 5/1951 | Gallaher | 232/17 |
| 4,244,512 | 1/1981 | Wise | 232/17 |
| 4,333,603 | 6/1982 | Carlson | 232/17 |
| 4,361,271 | 11/1982 | Hester et al. | 232/17 |
| 4,724,999 | 2/1988 | Fitzgerald et al. | 232/17 |
| 4,726,512 | 2/1988 | White | 232/17 |

*Primary Examiner*—Robert W. Gibson, Jr.
*Attorney, Agent, or Firm*—John P. Halvonik

[57] ABSTRACT

The invention is directed toward an improved mailbox that allows the recipient of mail to view from a distance the incoming mail chamber and determine if there is mail to pick up. In addition, the mailbox comes with a lockable incoming chamber and a protection flange that keeps out the hands of those that may tamper with the mail.

6 Claims, 1 Drawing Sheet

FIG 1
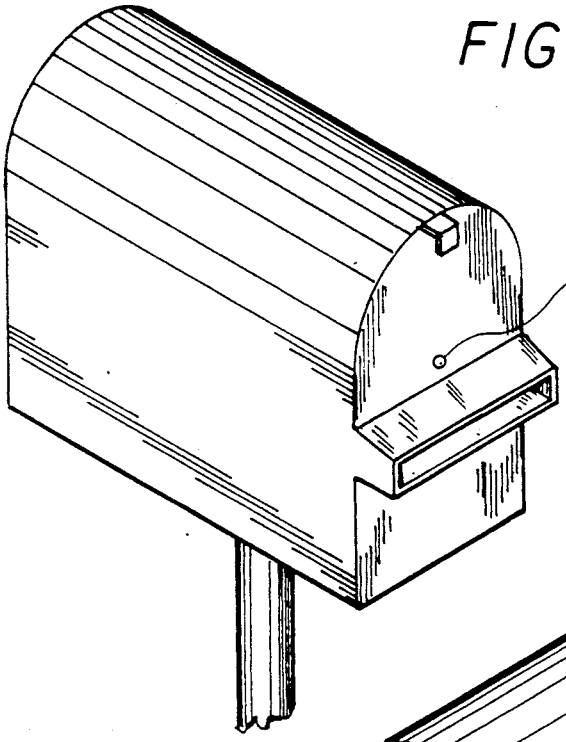
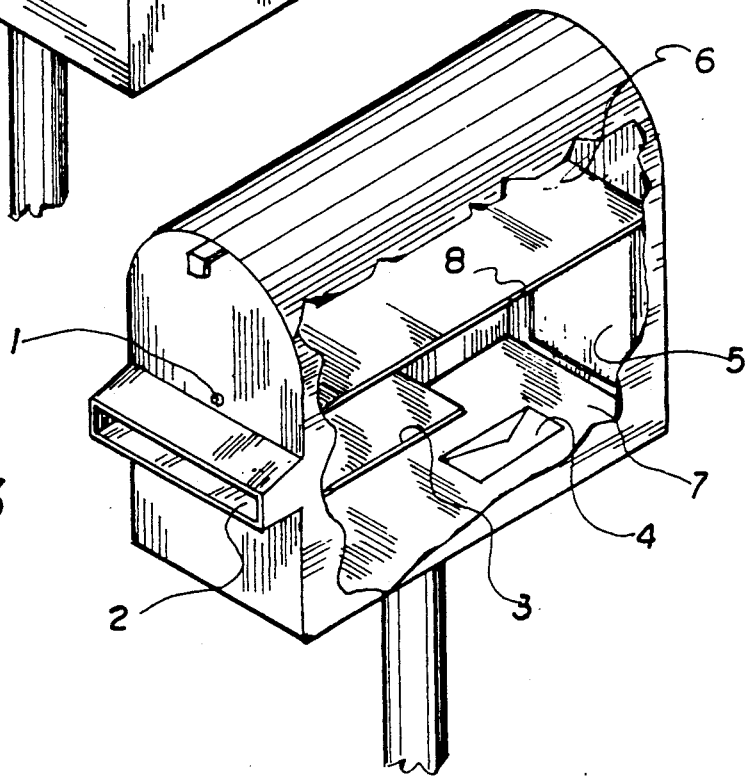
FIG 3
FIG 2
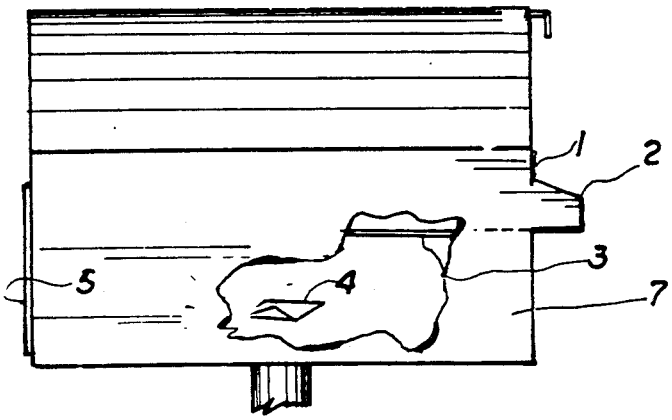

SAFE T BOX

BACKGROUND OF THE INVENTION

This invention relates to the field of letteerboxes and in particular with those secured against tampering by use of a locked compartment for incoming mail.

Similar items exist, see like U.S. Pat. Nos. 4,333,603 and 4,361,271 which provide a locked mail box. None of these provide an openable container for the storage of outgoing mail before the postman comes to pick it up and a locked container for incoming mail that has an inwardly projecting flange that prevents evil doers from reaching their hands into the box.

SUMMARY OF THE INVENTION

A letterbox capable of being locked for preventing others from tampering with the mail. It consists of a lockable door with a slot for the delivery of mail and an inwardly directed flange inside the box and beneath the slot. The slot prevents people from tampering with the mail that has arrived. Above the slot is an outgoing mail container that is not locked but merely pulled open by the mail man. The back of the incoming mail container is made of a transparent material and allows the recipient to see if mail has come and thereby save them the trip of going to the mailbox.

Among the advantages of the present invention is that it provides a secured mail box that can be locked while permitting the entry of incoming mail.

Another advantage is that the invention prevents the unwanted tampering of mail through the delivery slot.

Still another advantage is that it provides for an easily accessible mail container for the temporary holding of outgoing mail.

Another advantage is that the mail box allows the recipient of mail to see if mail has arrived.

BRIEF DESCRIPTION OF THE DRAWINGS

FIG. 1. Side view of the mail box.

FIG. 2. Front view of the mail box.

FIG. 3. Three Quarter view of the mail box.

DESCRIPTION OF THE INVENTION

The mail box is divided into two compartments, which can be divided by a dividing piece (8). The lower compartment (7) is preferably the incoming compartment. The incoming compartment has a locked door with a slot (2) in the door to permit the entry of mail by the mail man as he makes his rounds. The door is locked while the mail man is making his rounds so no one is able to access the arrived mail. On the inside of the door is a flange (3) that projects in toward the compartment and directly beneath the slot on the door. This flange prevents the unauthorized tampering of mail (4) in the lower compartment because the flange is large enough to keep a person's hands from reaching in through the slot and reaching the mail. Of course, the slot cannot be so large as to prevent the mail man from sliding the mail over the flange. Thus, the mail sits in the bottom of the lower compartment, out of harm's way. The flange should thus be about 2–6 inches long. Longer flanges can possibly be used but in these cases the flange should be angled downward so that the mail can slide over the flange, without the angle mail might sit on the flange and be vulnerable to someone reaching his hands into the compartment and stealing the mail.

The outgoing chamber is usually the upper chamber (6) and has a lid and is capable of being opened without a key. This provides a storage place for the mail until the postman comes along to pick it up. It may also be equipped with a flag or other signalling means to indicate to the post man that there is mail ready to be picked up.

The present invention has a transparent window (5) in the back wall of the receiving compartment for incoming mail. The window allows the recipient of mail to glance at the mail box and to tell at an instant whether there is mail in the box. This saves on the trip of going to the mail box in the event that there is no mail in the box. Of course, the window must be made of sturdy, nearly unbreakable, material.

The letterbox (or mail box) should be made of sturdy and weatherproof materials. Preferably, stainless steel or aluminum. The transparent material that the back is made of can be plexiglass or other hard-to-break transparent material. Alternately the incoming compartment could be placed on the top and the outgoing mail compartment could be on the bottom. Other arraangements of the compartments are possible without violating the spirit of this invention.

I claim:

1. An improved mailbox of rigid material comprising: a rigid structure enclosing a chamber, said structure including a bottom wall, a top wall, left and right side walls, rear wall and front wall, said top wall integral with top edges of said front back, and left and right side walls, said front wall integral with front edges of said left and right side walls, bottom wall and top wall, said rear wall integral with back edges of said top side and bottom walls and said bottom wall integral with bottom edges of said front, back, and side walls, an interior partition within said chamber whose sides are integral with said side, front and back walls at a point about half way up said walls, said partition dividing said chamber into upper and lower chambers, said front wall having an upper door and lower door, said lower door capable of being locked and capable of permitting access to lower chamber, said upper door capable of permitting access to said upper chamber; said lower door having a slot, said slot located below said partition and capable of allowing mail to enter through said slot and to be deposited within said lower chamber, said slot having an annular flange around the periphery of said slot, said annular flange extending outwardly from said lower door, said slot having an inner flange located below said slot and extending toward the interior of said lower chamber, said inner flange capable of preventing the entry of hands through said slot and into said lower chamber, said back wall having a window, said window capable of allowing viewing of contents of said lower chamber, 2. The apparatus of claim 1 where said inner flange is of a width about equal to the width of said lower chamber.

3. The apparatus of claim 2 wherein said inner flange is between about 2 and 6 inches in length.

4. The apparatus of claim 1 wherein said window is made of plexiglass.

5. The apparatus of claim 1 wherein said rigid material is steel.

6. The apparatus of claim 1 wherein said rigid material is aluminum.

* * * * *